US009387947B2

(12) United States Patent
Eno et al.

(10) Patent No.: US 9,387,947 B2
(45) Date of Patent: Jul. 12, 2016

(54) CARRIAGE FOR COILED METAL

(71) Applicant: NUCOR CORPORATION, Charlotte, NC (US)

(72) Inventors: Eron Eno, Blytheville, AR (US); John Ackerman, Blytheville, AR (US); Jason Malone, Blytheville, AR (US); Clayton Tilley, Blytheville, AR (US)

(73) Assignee: Nucor Corporation, Charlotte, NC (US)

( * ) Notice: Subject to any disclaimer, the term of this patent is extended or adjusted under 35 U.S.C. 154(b) by 670 days.

(21) Appl. No.: 13/799,101

(22) Filed: Mar. 13, 2013

(65) Prior Publication Data

US 2014/0260092 A1 Sep. 18, 2014

(51) Int. Cl.

| | |
|---|---|
| ***B65B 27/06*** | (2006.01) |
| ***B21C 47/02*** | (2006.01) |
| *B65H 75/28* | (2006.01) |

(52) U.S. Cl.

CPC ..... *B65B 27/06* (2013.01); *B21C 47/02* (2013.01); *B65H 75/285* (2013.01); *Y10S 414/123* (2013.01)

(58) Field of Classification Search

CPC ..... B65B 27/06; B21C 47/00; B21C 47/02; B21C 47/14; B21C 47/16; B21C 47/24; B21C 47/247; B21C 47/22; Y10S 414/121; Y10S 414/123; B65H 75/285

USPC ..... 100/2, 12; 242/363, 533.3, 533.7, 242/533.8; 53/399, 116; 198/465.2; 414/684, 908

See application file for complete search history.

(56) References Cited

U.S. PATENT DOCUMENTS

| | | | | | |
|---|---|---|---|---|---|
| 2,198,644 | A * | 4/1940 | Wettengel | B21C 47/24 | 193/36 |
| 3,747,446 | A * | 7/1973 | Davis | B21C 37/127 | 82/53.1 |
| 4,360,854 | A * | 11/1982 | Schergen | H01F 13/006 | 361/149 |
| 5,044,862 | A * | 9/1991 | Herigstad | B65H 19/126 | 242/559 |
| 5,956,990 | A * | 9/1999 | Ginzburg | B21B 1/463 | 242/527.5 |
| 6,056,232 | A * | 5/2000 | Karaki | G03B 27/588 | 242/559.3 |
| 2007/0011858 | A1* | 1/2007 | Maxwell | B23K 31/02 | 29/431 |
| 2010/0294874 | A1* | 11/2010 | Niehues | B21C 47/24 | 242/520 |

* cited by examiner

*Primary Examiner* — Jimmy T Nguyen
(74) *Attorney, Agent, or Firm* — Hahn, Loeser & Parks, LLP; Arland T. Stein

(57) ABSTRACT

A carriage for conveyance of a coil of ferromagnetic metal includes a base portion having a carrier supporting, a suspension mechanism, and a cradle portion, supported relative to the base portion by the suspension mechanism, the cradle portion having a magnetic saddle for engaging the coil of ferromagnetic metal.

18 Claims, 6 Drawing Sheets

CARRIAGE FOR COILED METAL

BACKGROUND AND SUMMARY

This invention relates to metal sheet coiling systems and more particularly to a carriage for a coiled metal sheet.

Coiling machines are generally known in the sheet metal or metal strip industries. Coiling machines forming long lengths of sheet or strip into coils which may then be more practical to move, for example to a finishing or manufacturing facility. In coiling these lengths of sheet or strip, the sheet or strip is typically wound about a spindle, for example a mandrel, and secured against unraveling before being conveyed away from the spindle, for example on a carriage.

There are various forms of securing coils against unraveling. For example, these include welding an outside edge of the coil to another portion of the coil, or binding the coil with straps. Typically, in order to prevent the coil from unwinding, the coil will secured while it is under tension on the spindle. Once the coil is secured, the spindle may be manipulated to release the tension on the coil, and allow the coil to be removed from the spindle.

A carriage for conveyance of a coil of ferromagnetic metal, the carriage includes a base portion having a carrier supporting a suspension mechanism, and a cradle portion, supported relative to the base portion by the suspension mechanism, the cradle portion having a magnetic saddle for engaging the coil of ferromagnetic metal.

The magnetic saddle may include a core of permanent magnetic material. The magnetic saddle may include electromagnet. The magnetic saddle may include a cover, which may be of permanent magnetic material, ferromagnetic metal, or any other suitable material.

The base portion may include a bracket connected to a transportation mechanism. The transportation mechanism may include at least one wheel-axel assembly. The transportation mechanism may include a sled. The base portion may include a bracket for cooperation with a transportation rail.

DETAILED DESCRIPTION

Figure 1:
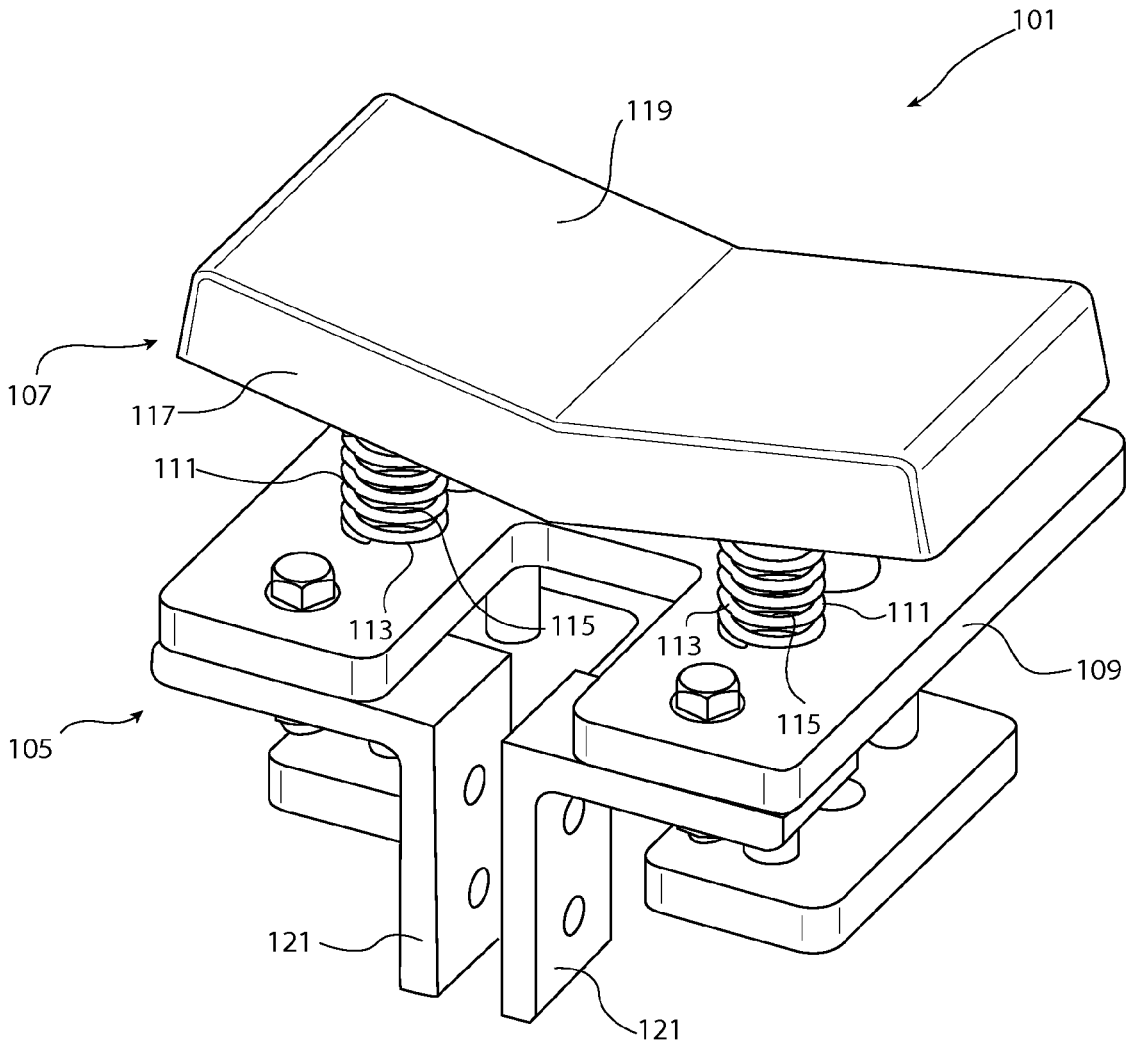
FIG. 1 is a perspective view of a carriage for a coiled strip of a sheet of a ferromagnetic metal.
Figure 2:
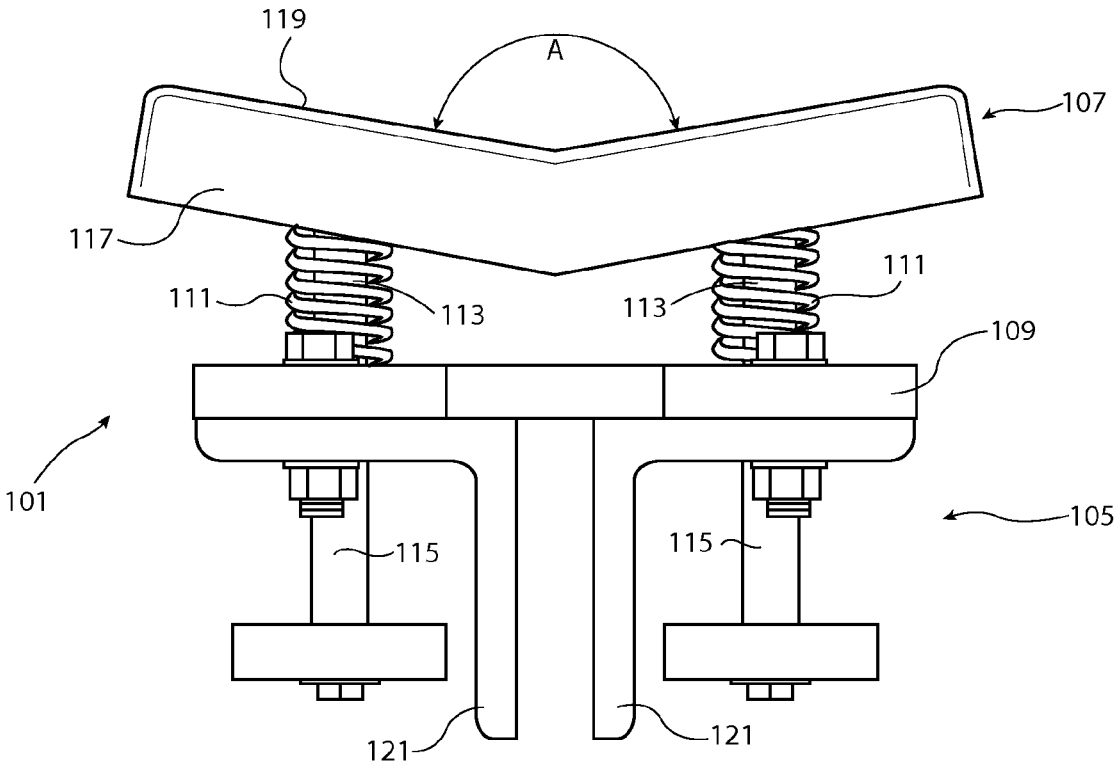
FIG. 2 is a front view of the carriage of FIG. 1.
Figure 3:
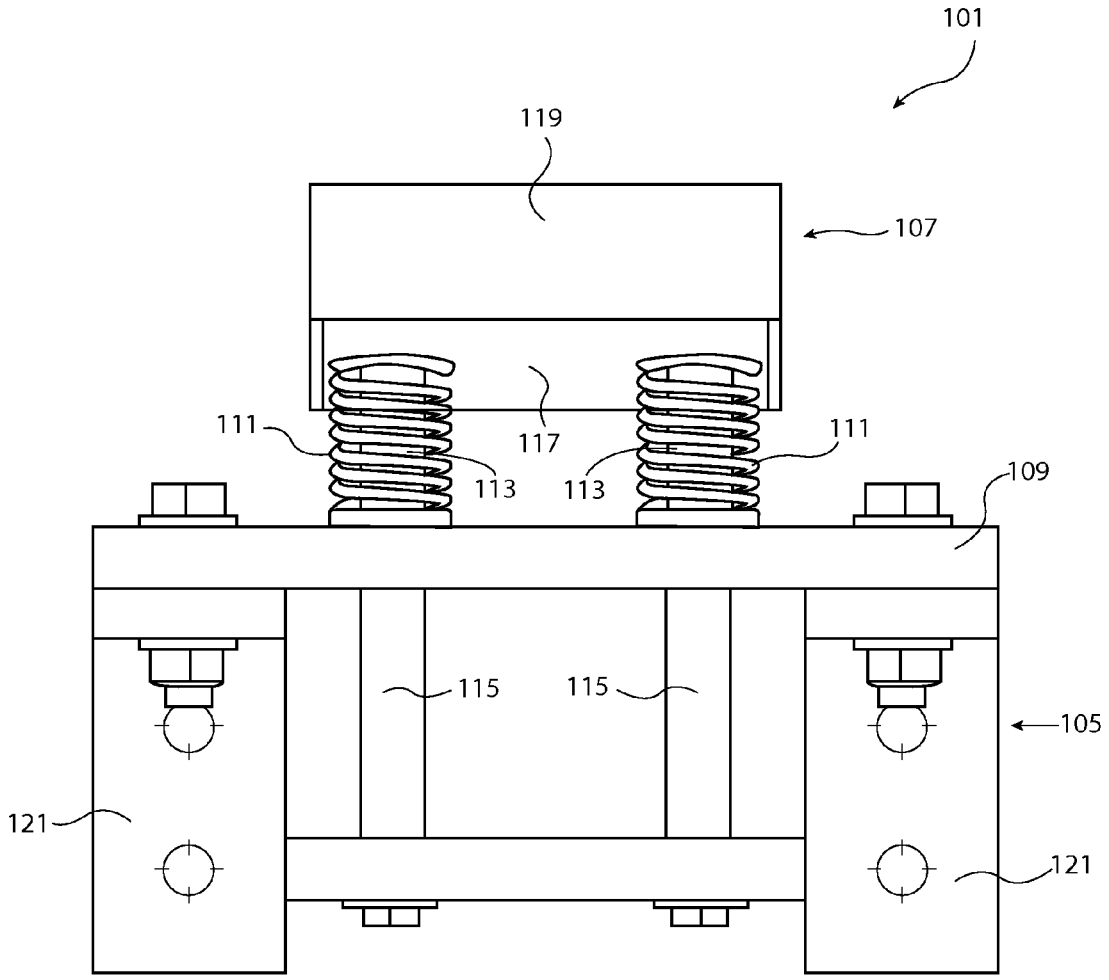
FIG. 3 is a side view of the carriage of FIG. 1.
Figure 4:
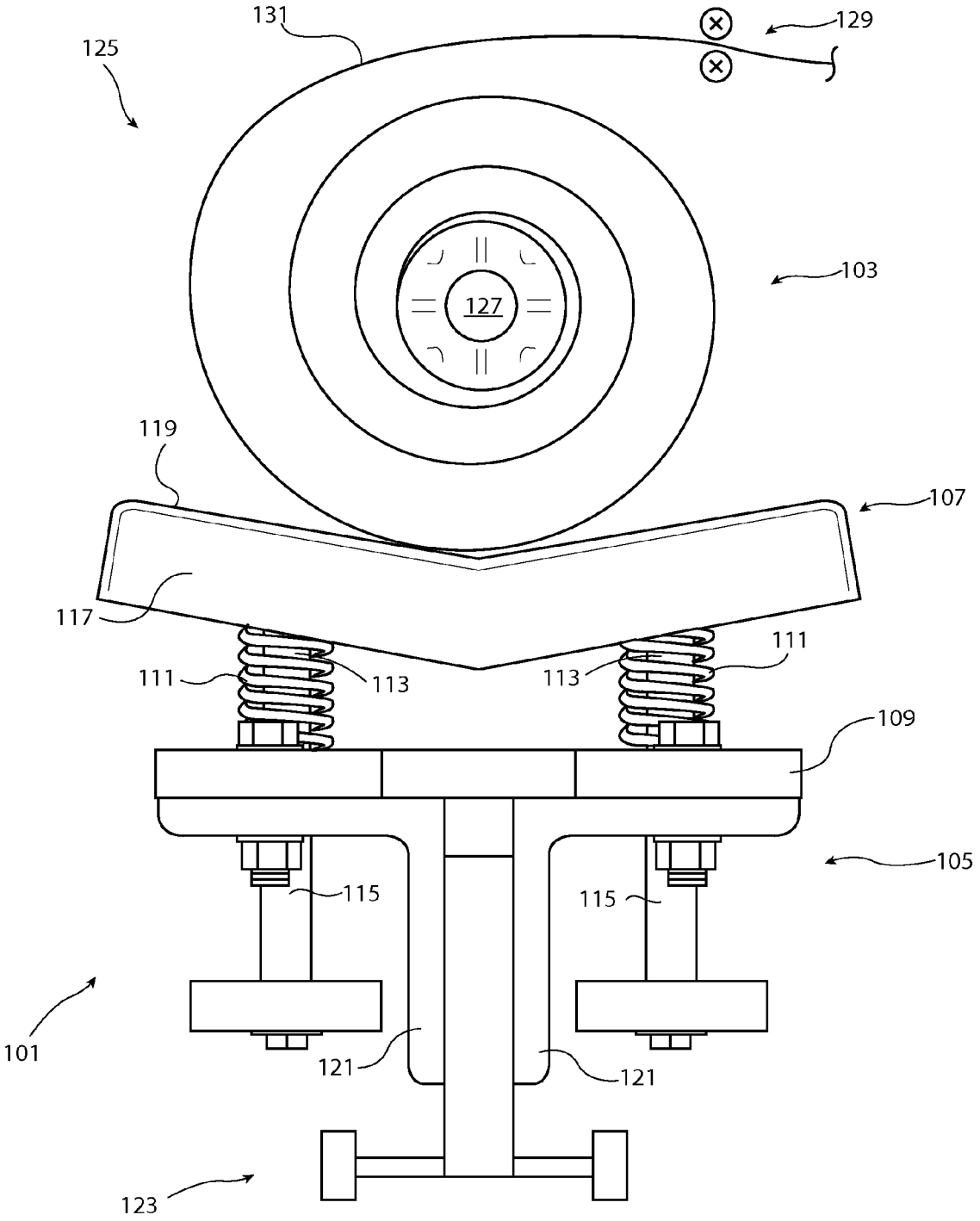
FIG. 4 is a front view of the carriage of FIG. 1 positioned relative to a coiling machine.
Figure 5:
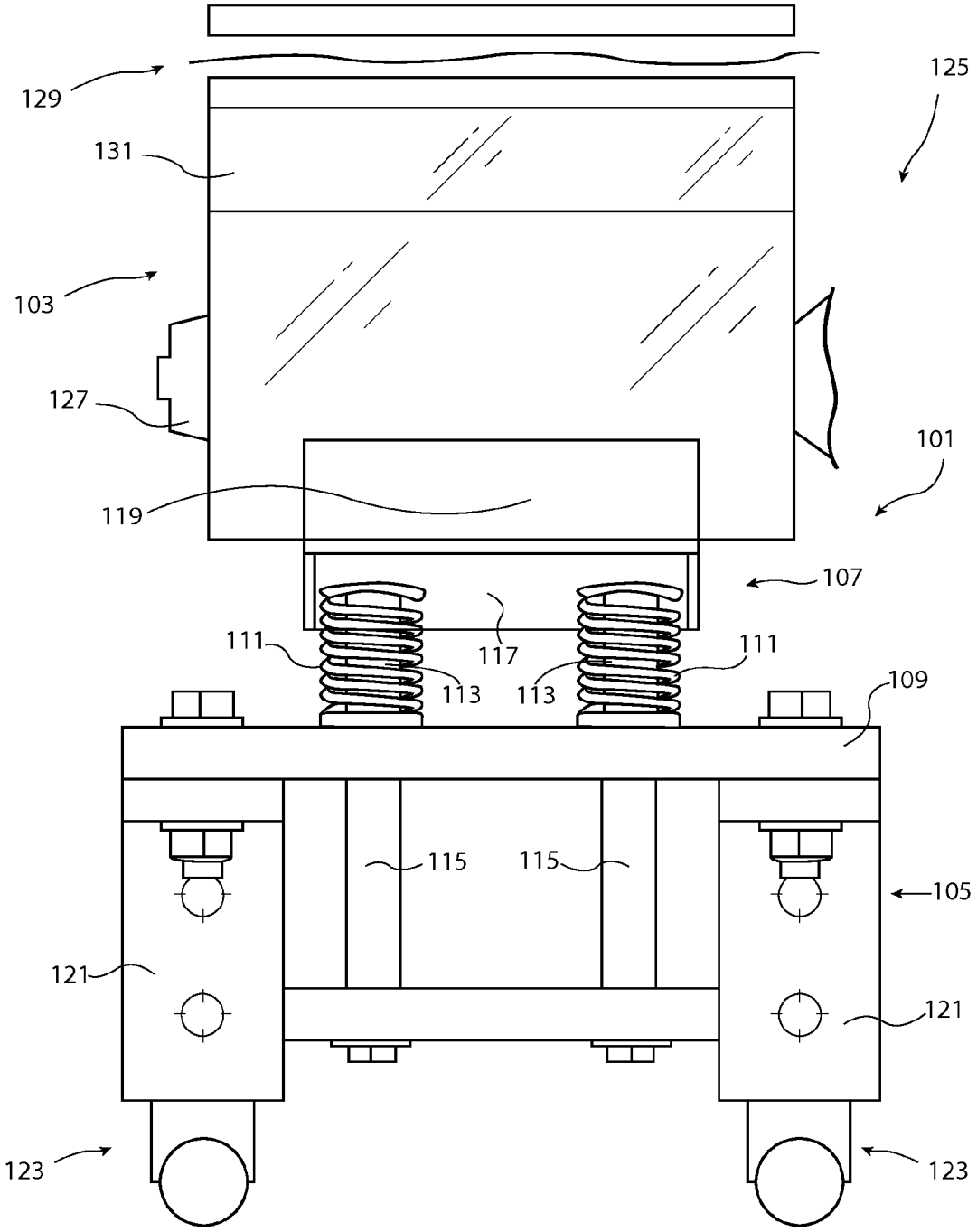
FIG. 5 is a side view of the carriage and coining machine of FIG. 4.
Figure 6:
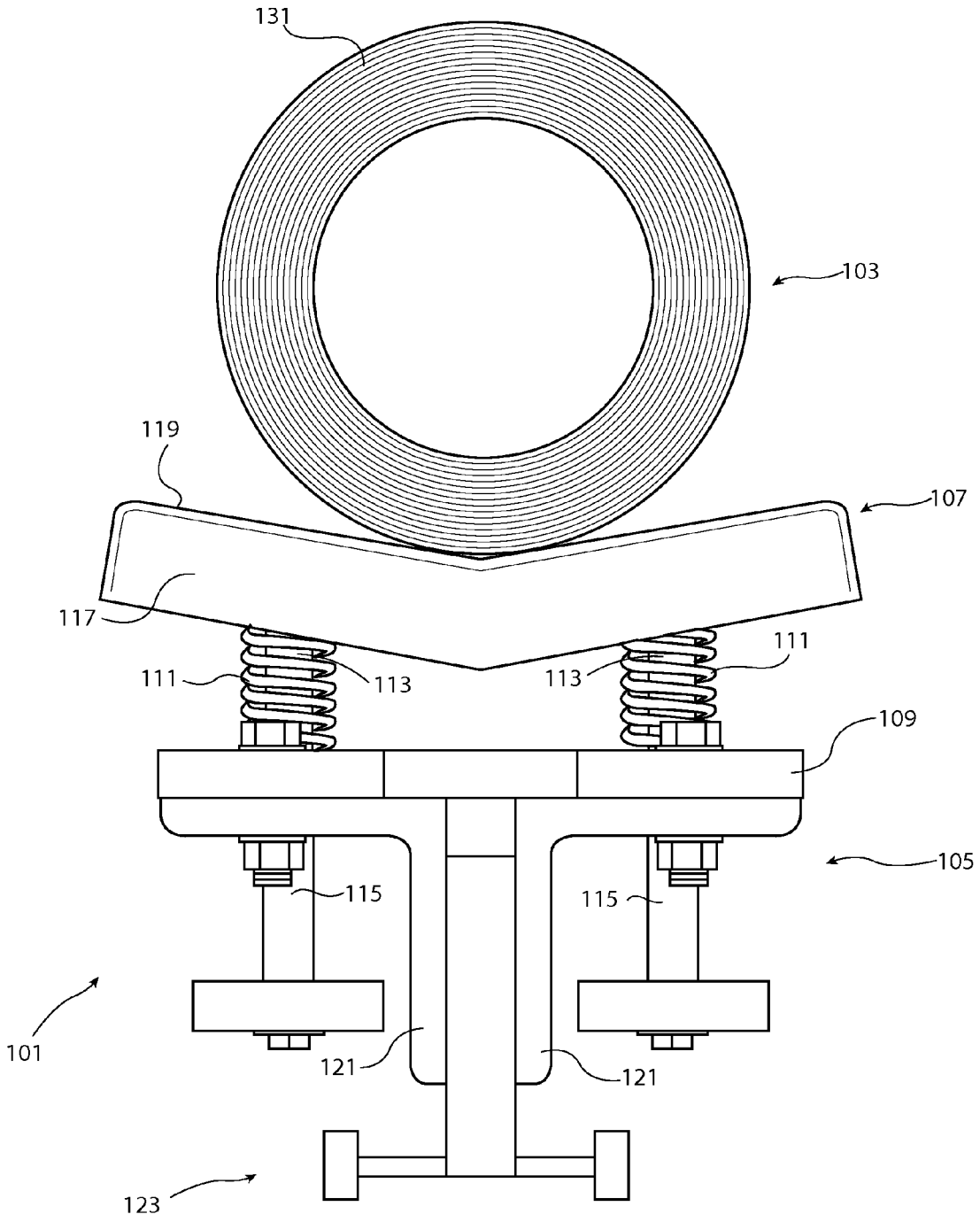
FIG. 6 is a view similar to FIG. 4 except showing the coil from the coiling machine loaded upon the carriage.

Referring to FIGS. 1-3, a carriage 101 for conveyance of a coil 103, see FIGS. 4-6, of ferromagnetic metal includes a base portion 105 and a cradle portion 107. The base portion 105 includes a carrier 109 supporting a suspension mechanism 111. The cradle portion 107 is supported relative to the base portion 105 by the suspension mechanism 111. The suspension mechanism may, for example, include a number of springs 113, hydraulic or pneumatic shock absorbers, or any other devices to suitable to accommodate forces between the base portion 105 and the cradle portion 107. In the illustrated example, the springs 113 are each shown cooperating with a respective post 115.

The cradle portion 107 includes a magnetic saddle 117 for engaging the coil 103 of ferromagnetic metal. In the illustrated example the magnetic saddle 117 includes a core of permanent magnetic material, such as a rare earth metal or alloy and a cover 119, such as a stainless steel cover. Additionally or alternatively, the magnetic saddle 117 may also include an electromagnet.

According to one embodiment, the magnetic saddle 117 may include one or more permanent magnets and may include a core of magnetic material. The core may be magnetized iron or iron-alloy, rare earth metal, composites, or other well known types of ferromagnetic materials.

According to an alternative arrangement the magnetic saddle 117 includes one or more selectively engageable electromagnets. In this arrangement, the carriage 101 may include structure for electrically connecting the electromagnets in the magnetic saddle 117 with an electrical source.

According to one embodiment, the magnetic saddle 117 is may be permanent magnet having a continuous magnetic field. The magnetic saddle 117 may be formed at a desired angle A, such as 160 degrees, for engagement of the coil 103, but may be any other angle suitable to engage the coil 103. The magnetic saddle 117 also is shown as having a V-shape with two sections arms extending from one another, although such is not required and the magnetic saddle 117 may have any suitable shape such as flat, elliptical, semi-circular or any other shape suitable to engage the coil 103.

The magnetic saddle 117 may be divided into multiple magnetic sections. For example, the magnetic saddle 117 may include four sections with alternating polarities. It is expected that this alternating polarity arrangement may provide for increased securement of the coil 103 to the magnetic saddle 117 as compared to having continuous polarity. It is contemplated that the magnetic saddle 117 may be divided into more or fewer sections of alternating polarities, or may include adjacent sections having similar polarities. It is further contemplated that the magnetic saddle 117 may not have alternating polarities.

In the illustrated example, the carriage 101 consists of two parts: a base portion 105 fixed to the transportation mechanism 123 and a cradle portion 107 connected to the magnetic saddle 117. The cradle portion 107 includes the magnetic saddle 117 connected to two or more posts 115 biased by springs 113 against the base portion 105. The carrier 109 of the base portion 105 of provides a surface for the springs 113 to bias against when engaging the magnetic saddle 117. The posts may be engaged by hydraulic or pneumatic (fluidic) actuators (not shown) that adjust the height of the cradle portion 107 relative to the base portion 105. The springs 113 bias the magnetic saddle 117 toward one position. In one arrangement with springs 113 and fluidic actuators, for example, the springs 113 are tension springs biasing the magnetic saddle 117 to a lowered position and the fluidic actuators raise the magnetic saddle 117. In another arrangement the springs 113 are compression springs biasing the magnetic saddle 117 to a raised position and the fluidic actuators lower the magnetic saddle 117.

The base portion 105 includes at least one bracket 121 connected to at least one transportation mechanism 123, see FIGS. 4-6. In the illustrated example the transportation mechanism 123 includes at least one wheel-axel assembly. In other alternatives, the transportation mechanism 123 may include a sled, or engagement for a transportation rail, or any other suitable mechanism to allow for the movement of the carriage 101 to provide conveyance of the coil 103. Thus, the magnetic saddle 117 may be secured to the transportation mechanism 123 via the carrier 109 and bracket(s) 121.

Referring now to FIG. 4-6, the carriage 101 may be part of a coiling system 125. The illustrated coiling system 100 includes a spindle, such as a mandrel, 127, a feed apparatus 129 and the carriage 101. The feed apparatus 129 is shown as including a pair of guide rolls, but may be any device suitable to deliver ferromagnetic metal for coiling to the spindle 127, such as, but not limited to a rolling table or any other type of apparatus.

A length of ferromagnetic metal 131 is fed to the spindle 127 through via feed apparatus 129 and wound about the spindle 127. The length of ferromagnetic metal 131 is preferably a sheet or thin strip of metal or metal alloy that be as cast or may have been rolled or pressed into sheet metal or thin strip which includes a ferromagnetic metal or alloy, such as a rare earth and/or ferro-magnetic or pseudo-ferro-ferromagnetic metal or alloy, such as iron, nickel, or cobalt.

The magnetic saddle 117 may thus be shaped and arranged to engage the coil 103 when the carriage 101 is advanced toward the spindle 127. The base portion 105 moveably connects the magnetic saddle 117 to the transportation mechanism 123, allowing the magnetic saddle 117 to be moved radially relative to the coil 103. The transportation mechanism 123 is provided to advance the carriage 101 axially towards the coil 103 and then away from the spindle 127, allowing the coil 103 to be removed from the spindle 127. Finally, the carrier 109 is provided to connect the magnetic saddle 117 to the transportation mechanism 123 and may include structure for raising the magnetic saddle 117 to engage the coil 103 when it is on the spindle 127.

One method for coiling a length of ferromagnetic metal, such as sheet steel, using the coiling system 125 and removing the coil 103 from the spindle 127 is described below. The method generally includes the steps of winding the length of ferromagnetic metal 131 about the spindle 127 to form the coil 103; advancing the carriage 101 having the magnetic saddle 117 to engage the coil 103; magnetically engaging the coil 103 with the magnetic saddle 117; counter rotating the spindle 127 to release the coil 103, or otherwise releasing the coil 103 from the spindle 127, and withdrawing the carriage 101 and coil 103 from the spindle 127, to convey the coil 103 away from the spindle 127.

According to a first step, an end of the length of ferromagnetic metal 131 is fed through the feed apparatus 129 and engages the spindle 127. The spindle 127 is rotated, drawing the length of ferromagnetic metal 131 through the feed apparatus 129 and winding it into the coil 103.

According to a second step, a carriage 101 having a saddle 117 is advanced to engage the coil 103. Once the coil 103 has been produced, the carriage 101 advances towards the spindle 127 and receives the coil 103. The coil 103 may be bound or loose when it is approached by the carriage 101. The carriage 101 is magnetized, either permanently or by electromagnet, to carry the coil 103 from the spindle 127. It is contemplated that in the case where the coil 103 is unbound, the coil 103 may then be conveyed by the carriage 101 to a separate bander away from the spindle 127 before removed from the carriage 101.

As previously discussed, the carriage 101 includes the magnetic saddle 117 for engaging the coil, transportation mechanism 123 for advancing the carriage 101, and a carrier 109 connecting the magnetic saddle 117 to the transportation mechanism 123. The carrier 109 includes a base portion 105 connected to the transportation mechanism 123 and a cradle portion 107 connected to the magnetic saddle 117. When the carriage 101 is advanced to a position near the coil 103 the fluidic actuators (not shown) may be engaged to raise the cradle portion 107 and saddle 117 adjacent the coil 103.

As discussed above, in certain embodiments the magnetic saddle 117 is a permanent magnet and the magnetic saddle 117 will magnetically engage the coil 103 when the magnetic saddle 117 is moved to close proximity with the coil 103. In other embodiments the magnetic saddle 117 may include one or more electromagnets, and therefore it is necessary to include the additional step of electrically powering the electromagnets.

According to a third step the coil 103 is magnetically engaged with the magnetic saddle 117. When the coil 103 is magnetically engaged there will be created within the coil 103 a magnetic field. This magnetic field will create a perpendicular force between various layers of the coiled steel, increasing the resistance of the coil 103 to unwinding due to the increase of pressure across the surfaces of the layers of the coil 103 and the frictional coefficient between the layers. This will deter unwinding of the coil 103 even once it is no longer under tension due to the spindle 127. Optionally, alternating polarities of magnets in the magnetic saddle 117 may selected as desired to alter this effect.

According to one arrangement, the magnetic saddle 117 includes one or more permanent magnets. These permanent magnets are arranged with alternating polarities and have a fixed strength. According to alternative arrangements the magnetic saddle 117 is provided with one or more electromagnets. The strength and polarity of the electromagnets may be varied on during the operation, allowing for a varying magnetic field strength as desired. In one arrangement, the magnetic field strength may be altered depending on the thickness of the ferromagnetic metal. The field strength may be selected to be stronger for thicker steel and weaker for thinner material. The field may also be altered depending up the composition of the ferromagnetic metal.

According to the next step, the spindle 127 is counter-rotated, or otherwise controlled, to release the coil 103 from the spindle 127. During the winding operation the coil 103 may be tightly coiled about the spindle 127. In order to remove the coil 103 from the spindle 127 it may be necessary to loosen the coil 103 or to collapse the spindle. This may be achieved by rotating the spindle 127 in the direction opposite the winding direction, loosening the coil 103 and allowing it to be removed from the spindle 127, or by retracting fingers of the spindle 127.

Finally, the coil 103 is removed from the spindle 127. This step is achieved by withdrawing the carriage 101 and saddle 117 axially away from the spindle 127. While the magnetic saddle 117 is near or adjacent the coil 103 the coil 103 will be prevented from unraveling by the increased pressure between various layers of the coil 103 caused by the magnetic field. Therefore, the coil 103 may be withdrawn from the spindle 127 without risk of uncoiling.

Once the coil 103 has been withdrawn from the spindle 127, the coil 103 may be transported while maintaining the magnetic field on the magnetic saddle 117. The coil 103 may then be bound by welding, binding straps, or other means well known in the art, as desired Once bound, the coil 103 may be removed from the magnetic field, either by removing the electrical charge from the electromagnets within the magnetic saddle 117 or by removing the coil 103 from the magnetic saddle 117.

While principles and modes of operation have been explained and illustrated with regard to particular embodiments, it must be understood, however, that this may be practiced otherwise than as specifically explained and illustrated without departing from its spirit or scope.

What is claimed is:

1. A coiling system configured to coil ferromagnetic material comprising:

(a) a spindle configured to engage a strip of ferromagnetic metal and to coil the strip of ferromagnetic metal by rotating the spindle forming a coil of ferromagnetic metal;

(b) a carriage positioned under the coil of ferromagnetic metal and configured to engage the coil of ferromagnetic metal, the carriage comprising:

a base portion including a carrier, a cradle portion having a magnetic saddle portion configured to engage and support the coil of ferromagnetic metal, and a suspension mechanism supported by the carrier and configured to support the cradle portion, (c) a transportation mechanism configured to withdraw the coil of ferromagnetic metal from the spindle while supported by the carriage, and (d) a banding device configured to band the coil of ferromagnetic metal while the carriage holds the coil of ferromagnetic metal from substantially loosing.

2. The coiling system as claimed in claim 1 where the magnetic saddle portion includes a cover of permanent magnetic material.

3. The coiling system as claimed in claim 1 where the magnetic saddle portion includes a core of permanent magnetic material.

4. The coiling system as claimed in claim 3 where the magnetic saddle portion includes a cover of ferromagnetic metal.

5. The coiling system as claimed in claim 1 where the magnetic saddle portion comprises an electromagnet.

6. The coiling system as claimed in claim 1 where the transportation mechanism is adapted to support the base portion of the carriage.

7. The coiling system as claimed in claim 1 where the transportation mechanism includes at least one wheel-axle assembly.

8. The coiling system as claimed in claim 1 where the transportation mechanism includes a sled.

9. The coiling system of claim 1 where the base portion is adapted to be supported by a transportation rail.

10. A method of producing coils of ferromagnetic metal comprising the steps of:

(a) assembling a spindle adapted to engage a strip of ferromagnetic metal and to coil the strip of ferromagnetic metal by rotating the spindle forming a coil of ferromagnetic metal, (b) assembling a carriage positioned under the coil of ferromagnetic metal and adapted to engage the coil of ferromagnetic metal, the carriage comprising:

a base portion including a carrier, a cradle portion having a magnetic saddle portion adapted to engage and support the coil of ferromagnetic metal, and a suspension mechanism supported by the carrier and adapted to support the cradle portion, (c) withdrawing the coil of ferromagnetic metal from the spindle with a transportation mechanism while supported by the carriage, and (d) banding the coil of ferromagnetic metal while the carriage holds the coil of ferromagnetic metal from substantially loosing coiling.

11. The method of producing coils of ferromagnetic metal as claimed in claim 10 where the magnetic saddle portion includes a cover of permanent magnetic material.

12. The method of producing coils of ferromagnetic metal as claimed in claim 10 where the magnetic saddle portion includes a core of permanent magnetic material.

13. The method of producing coils of ferromagnetic metal as claimed in claim 12 where the magnetic saddle portion includes a cover of ferromagnetic metal.

14. The method of producing coils of ferromagnetic metal coiling as claimed in claim 10 where the magnetic saddle portion comprises an electromagnet.

15. The method of producing coils of ferromagnetic metal as claimed in claim 10 where the transportation mechanism is adapted to support the base portion of the carriage.

16. The method of producing coils of ferromagnetic as claimed in claim 10 where the transportation mechanism includes at least one wheel-axle assembly.

17. The method of producing coils of ferromagnetic metal coiling as claimed in claim 10 where the transportation mechanism includes a sled.

18. The method of producing coils of ferromagnetic metal as claimed in claim 10 where the base portion is adapted to be supported by a transportation rail.

* * * * *